US008328513B2

(12) United States Patent
Kirtley

(10) Patent No.: US 8,328,513 B2
(45) Date of Patent: Dec. 11, 2012

(54) SYSTEMS AND APPARATUS RELATING TO COMPRESSOR STATOR BLADES AND DIFFUSERS IN TURBINE ENGINES

(75) Inventor: Kevin R. Kirtley, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 493 days.

(21) Appl. No.: 12/650,876

(22) Filed: Dec. 31, 2009

(65) Prior Publication Data

US 2011/0158798 A1 Jun. 30, 2011

(51) Int. Cl.
*F01D 9/04* (2006.01)

(52) U.S. Cl. ..... 415/211.2; 415/914; 416/183; 416/228

(58) Field of Classification Search ..... 415/191, 415/211.2, 914; 416/183, 228, 231 R
See application file for complete search history.

(56) References Cited

U.S. PATENT DOCUMENTS

| | | | | |
|---|---|---|---|---|
| 3,578,264 | A | 5/1971 | Kuethe et al. | |
| 3,644,055 | A * | 2/1972 | Davis | 415/208.3 |
| 5,178,516 | A * | 1/1993 | Nakagawa et al. | 415/208.3 |
| 5,737,915 | A | 4/1998 | Lin et al. | |
| 6,554,569 | B2 * | 4/2003 | Decker et al. | 415/192 |
| 6,896,475 | B2 | 5/2005 | Graziosi et al. | |
| 7,101,151 | B2 | 9/2006 | Loringer et al. | |
| 7,559,741 | B2 * | 7/2009 | Reichert et al. | 415/173.1 |
| 8,162,604 | B2 * | 4/2012 | Kuhnel et al. | 415/211.1 |
| 2008/0131268 | A1 * | 6/2008 | Guemmer | 415/160 |
| 2009/0035130 | A1 * | 2/2009 | Sonoda et al. | 415/191 |

* cited by examiner

*Primary Examiner* — Edward Look
*Assistant Examiner* — Liam McDowell
(74) *Attorney, Agent, or Firm* — Mark E. Henderson; Ernest G. Cusick; Frank A. Landgraff

(57) ABSTRACT

A row of stator blades in a compressor of a combustion turbine engine, the combustion turbine engine including a diffuser located downstream of the compressor, and the row of stator blades disposed in close proximity to the diffuser; the row of stator blades comprising: a plurality of stator blades that include at least one of an inboard forward notch and an outboard forward notch.

19 Claims, 9 Drawing Sheets

SYSTEMS AND APPARATUS RELATING TO COMPRESSOR STATOR BLADES AND DIFFUSERS IN TURBINE ENGINES

BACKGROUND OF THE INVENTION

This present application relates generally to systems and apparatus for improving the efficiency and/or operation of combustion turbine engines. More specifically, but not by way of limitation, the present application relates to improved systems and apparatus pertaining to compressor diffusers and the design of later stage stator blades to improve the operation thereof.

It will be appreciated that in combustion turbine engines, the pressurized flow of air from the compressor is directed into a diffuser. In general, the diffuser is configured to slow and raise the pressure of the flow exiting the compressor while limiting losses. From the diffuser, the pressurized flow is fed into a plenum and, from there, directed to the combustor. Increasing the diffuser exit to inlet area is desirable in certain aspects, as discussed below; however, increasing this ratio increases the risk for boundary layer flow reversal and the significant losses associated therewith.

More specifically, the outlet to inlet area ratio of a compressor diffuser located between the high pressure compressor and combustor of a gas turbine engine generally is limited by the deleterious effects of the boundary layer growing on the end walls of the diffuser. The more quickly the area increases through the diffuser, the more rapid the pressure rise and more rapid the boundary layer growth until the momentum in the boundary layer is insufficient to overcome the rising pressure. The resulting flow reversal is associated with large energy losses. As one of ordinary skill in the art will appreciate, energizing the boundary layer in the diffuser and maintaining higher momentum through convective mixing is desirable. That is, the energized boundary layer may then withstand diffusers with a higher exit to inlet area ratio, and, as one of ordinary skill in the art will appreciate, lower diffuser exit mach numbers may be achieved with lower mixing loses.

The issues associated with high area ratio diffusers have been addressed with a variety of technologies. These include extended length diffusers, multi-passage diffusers, fluidic flow control using boundary layer blowing and or suction, and vortex generators. Each has an associated drawback, which generally include increased cost, reliability, and/or difficulty in implementation. For example, the classic vortex generator is a small tab with a trapezoidal shape placed at an angle to the incoming flow. The vortex generator is typically half the height of the boundary layer and these vortex generators are spaced about 3 to 6 times their height. However, such configurations, while optimal for boundary layer enhancement, are a challenge to manufacture with low cost and long life.

As a result, there is a need for system and apparatus that promote flow characteristics through this area of a turbine that both limit losses while allowing for increases in the ratio of exit area to inlet area.

BRIEF DESCRIPTION OF THE INVENTION

The present application thus describes a row of stator blades in a compressor of a combustion turbine engine, the combustion turbine engine including a diffuser located downstream of the compressor, and the row of stator blades disposed in close proximity to the diffuser; the row of stator blades comprising: a plurality of stator blades that include at least one of an inboard forward notch and an outboard forward notch. In some embodiments, a majority or all of the stator blades comprise at least one of an inboard forward notch and an outboard forward notch.

The present application further describes a row of stator blades in a compressor of a combustion turbine engine, the combustion turbine engine including a diffuser located downstream of the compressor, and the row of stator blades disposed in close proximity to the diffuser; wherein: each of the stator blades within the row comprises an inboard forward notch and an outboard forward notch; the row of stator blades comprises the first row of stator blades disposed in the upstream direction from the diffuser; each stator blade within the row of stator blades connects, at an outer radial edge, to an outer wall and, at an inner radial edge, to an inner wall; the outer wall defining an outer flowpath boundary of a main flowpath of the compressor and the inner wall defining an inner flowpath boundary of the main flowpath of the compressor; the inboard forward notch comprises a cut-out section that extends rearward a first predetermined distance from a leading edge of the stator blade along the inner wall, the first predetermined distance comprising a distance less than a length of the stator blade; and the outboard forward notch comprises a cut-out section that extends rearward a second predetermined distance from a leading edge of the stator blade along the outer wall, the second predetermined distance comprising a distance less than the length of the stator blade; the first predetermined distance of the inboard forward notch comprises a distance that allows a significant portion of the forward curvature of the airfoil of the stator blade to be bypassed by a flow through the inboard forward notch; and the second predetermined distance of the outboard forward notch comprises a distance that allows a significant portion of the forward curvature of the airfoil of the stator blade to be bypassed by a flow through the outboard forward notch.

These and other features of the present application will become apparent upon review of the following detailed description of the preferred embodiments when taken in conjunction with the drawings and the appended claims.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
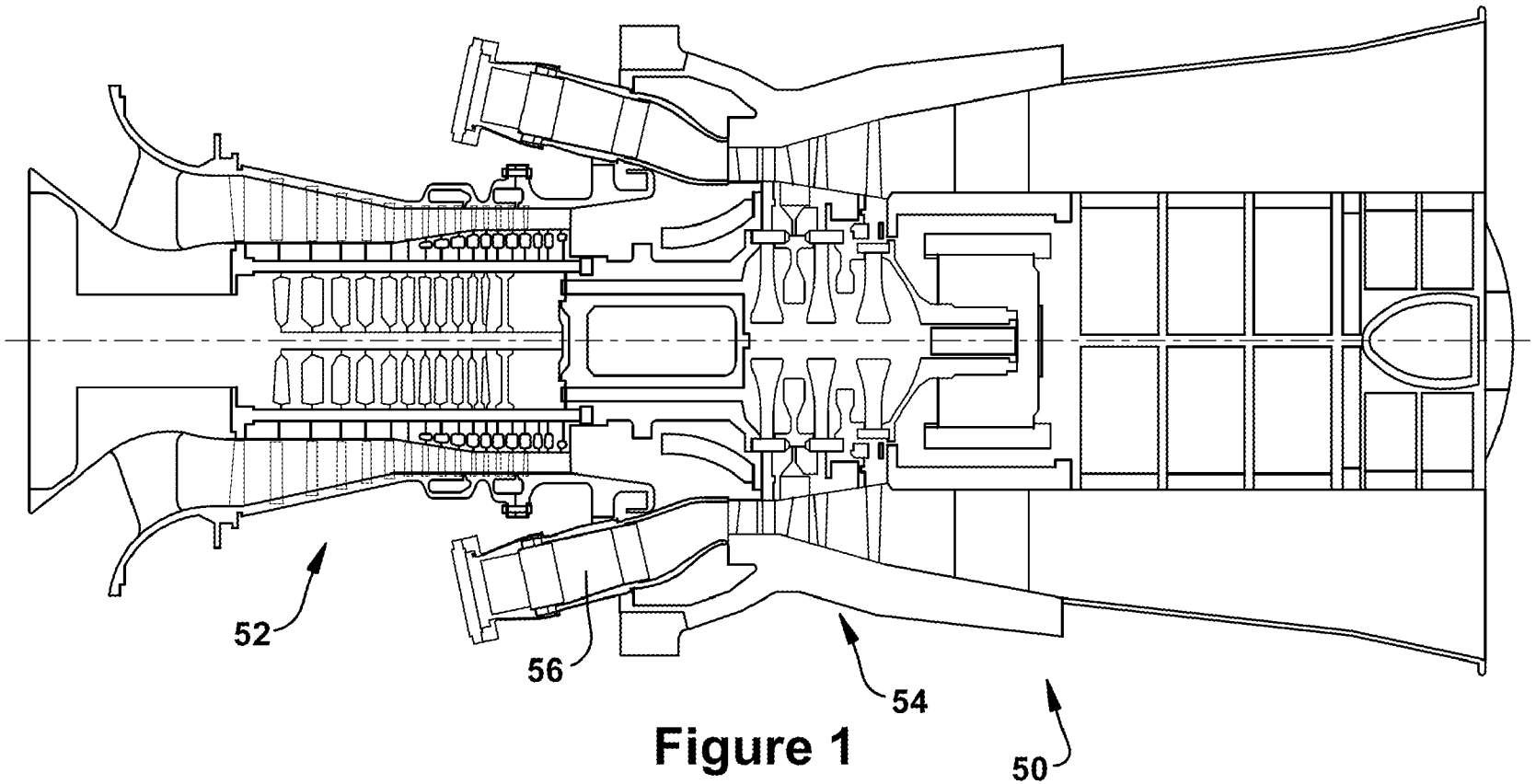
Figure 1 (Prior Art)
FIG. 1 is a schematic representation of an exemplary gas turbine engine in which embodiments of the present application may be used.
Figure 2:
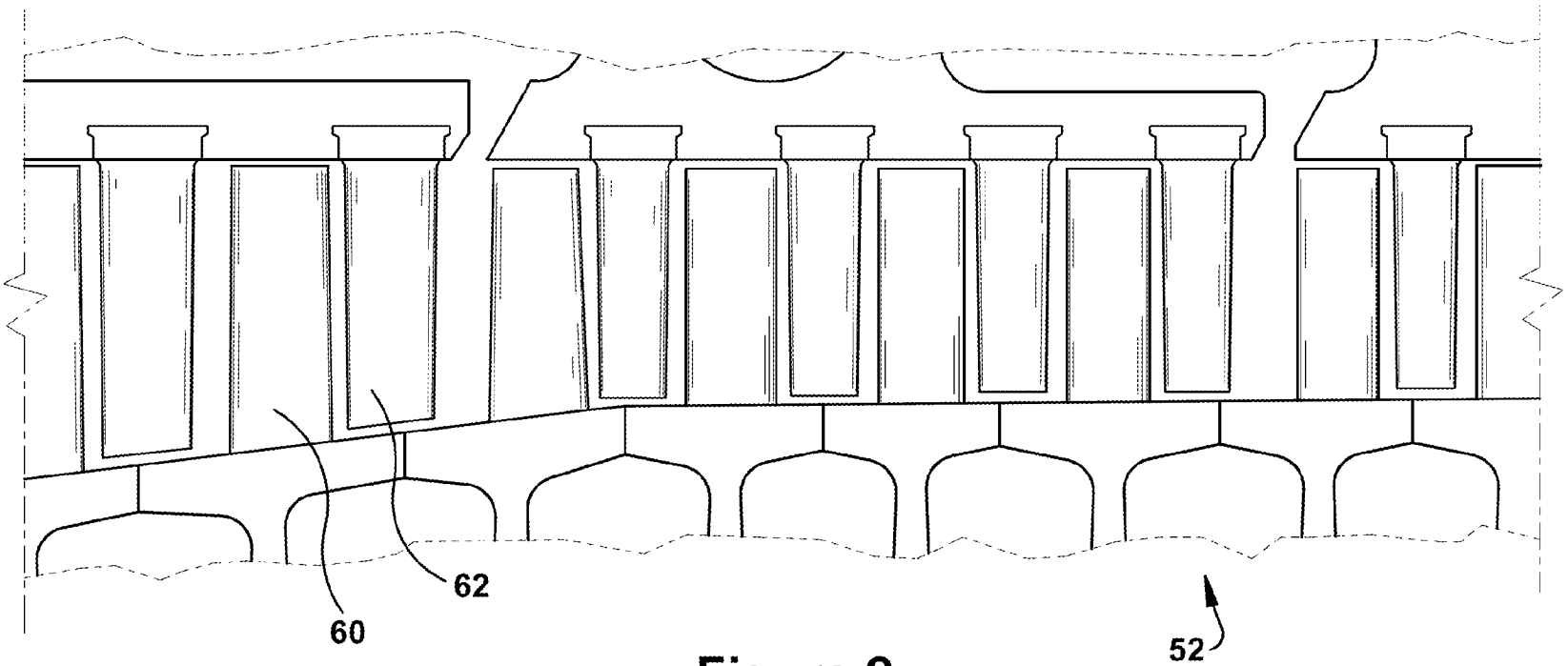
Figure 2 (Prior Art)
FIG. 2 is a sectional view of the compressor in the gas turbine engine of FIG. 1.
Figure 3:
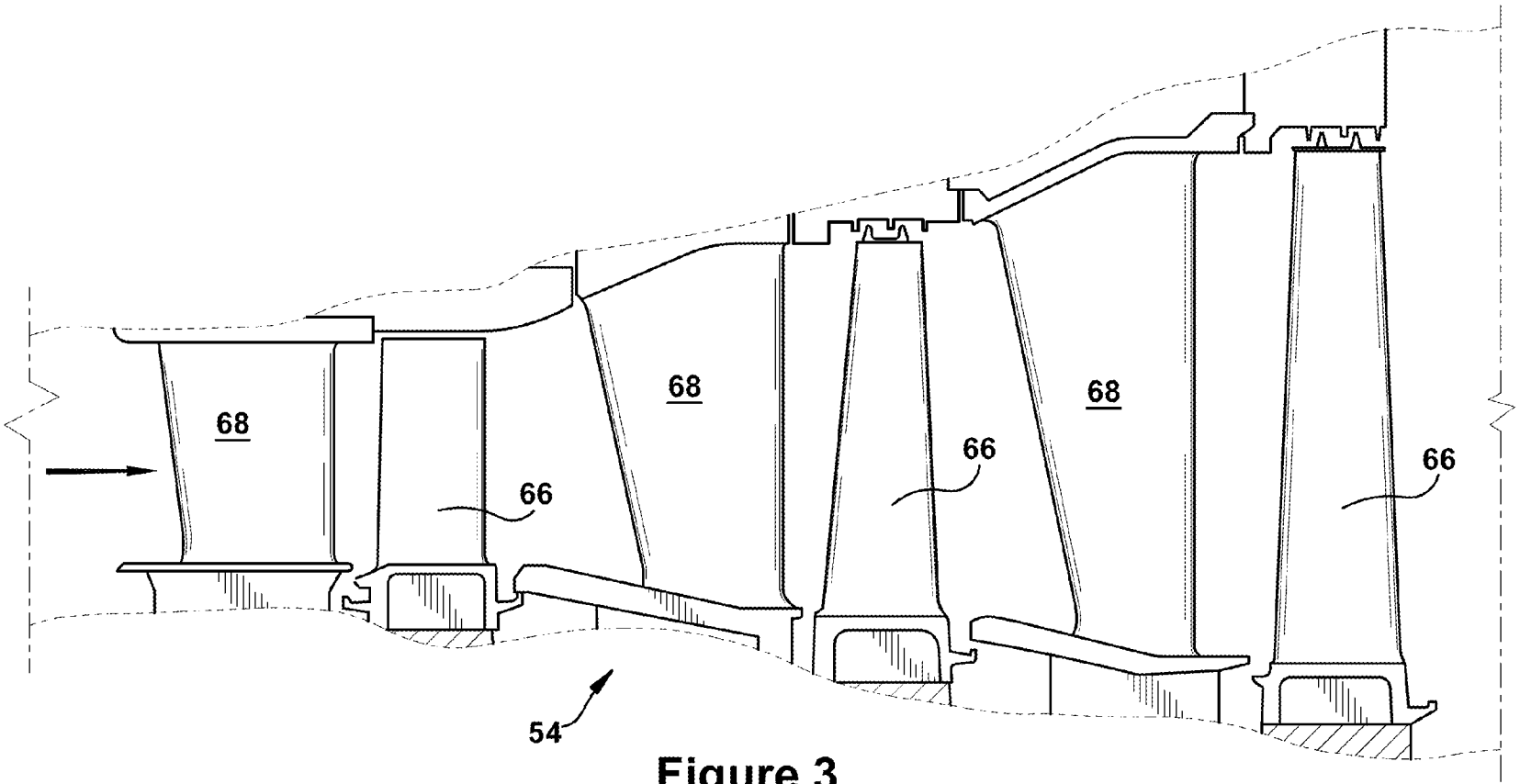
Figure 3 (Prior Art)
FIG. 3 is a sectional view of the turbine in the gas turbine engine of FIG. 1.

By way of background, referring now to the figures, FIGS. 1 through 3 illustrate an exemplary gas turbine engine in which embodiments of the present application may be used. FIG. 1 is a schematic representation of a gas turbine engine 50. In general, gas turbine engines operate by extracting energy from a pressurized flow of hot gas that is produced by the combustion of a fuel in a stream of compressed air. As illustrated in FIG. 1, gas turbine engine 50 may be configured with an axial compressor 52 that is mechanically coupled by a common shaft or rotor to a downstream turbine section or turbine 54, and a combustor 56 positioned between the compressor 52 and the turbine 56.

Figure 4:
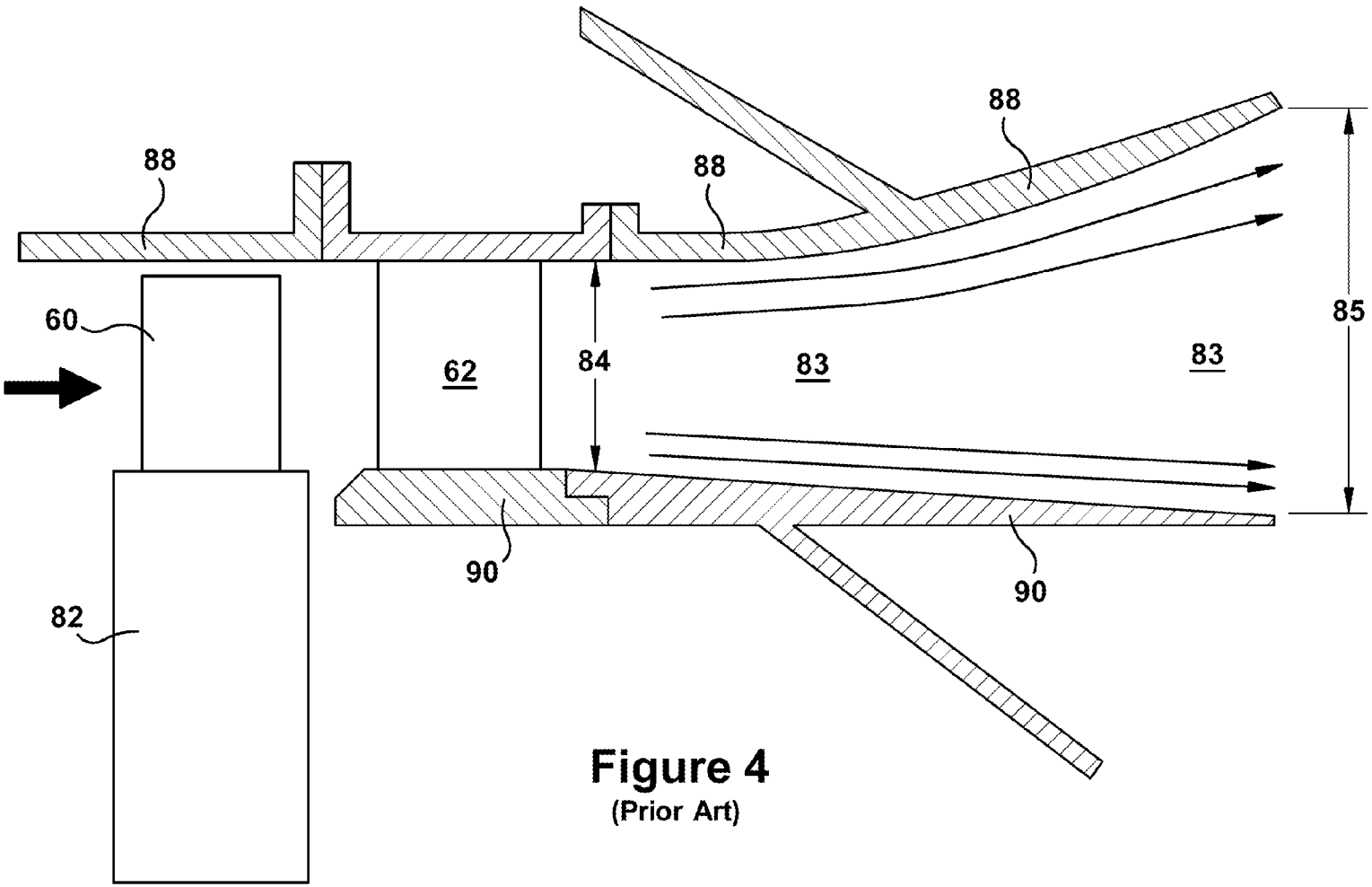
Figure 4 (Prior Art)
FIG. 4 is a sectional view of a configuration of the last stage of a compressor and the compressor diffuser according to conventional design.

FIG. 2 illustrates a view of an exemplary multi-staged axial compressor 52 that may be used in the gas turbine engine of FIG. 1. As shown, the compressor 52 may include a plurality of stages. Each stage may include a row of compressor rotor blades 60 followed by a row of compressor stator blades 62. (Note, though not shown in FIG. 2, compressor stator blades 62 may be formed with shrouds, an example of which is shown in FIG. 4.) Thus, a first stage may include a row of compressor rotor blades 60, which rotate about a central shaft, followed by a row of compressor stator blades 62, which remain stationary during operation. The compressor stator blades 62 generally are circumferentially spaced one from the other and fixed about the axis of rotation. The compressor rotor blades 60 are circumferentially spaced and attached to the shaft; when the shaft rotates during operation, the compressor rotor blades 60 rotate about it. As one of ordinary skill in the art will appreciate, the compressor rotor blades 60 are configured such that, when spun about the shaft, they impart kinetic energy to the air or fluid flowing through the compressor 52. The compressor 52 may have other stages beyond the stages that are illustrated in FIG. 2. Additional stages may include a plurality of circumferential spaced compressor rotor blades 60 followed by a plurality of circumferentially spaced compressor stator blades 62.

FIG. 3 illustrates a partial view of an exemplary turbine section or turbine 54 that may be used in the gas turbine engine of FIG. 1. The turbine 54 also may include a plurality of stages. Three exemplary stages are illustrated, but more or less stages may present in the turbine 54. A first stage includes a plurality of turbine buckets or turbine rotor blades 66, which rotate about the shaft during operation, and a plurality of nozzles or turbine stator blades 68, which remain stationary during operation. The turbine stator blades 68 generally are circumferentially spaced one from the other and fixed about the axis of rotation. The turbine rotor blades 66 may be mounted on a turbine wheel (not shown) for rotation about the shaft (not shown). A second stage of the turbine 54 also is illustrated. The second stage similarly includes a plurality of circumferentially spaced turbine stator blades 68 followed by a plurality of circumferentially spaced turbine rotor blades 66, which are also mounted on a turbine wheel for rotation. A third stage also is illustrated, and similarly includes a plurality of turbine stator blades 68 and rotor blades 66. It will be appreciated that the turbine stator blades 68 and turbine rotor blades 66 lie in the hot gas path of the turbine 54. The direction of flow of the hot gases through the hot gas path is indicated by the arrow. As one of ordinary skill in the art will appreciate, the turbine 54 may have other stages beyond the stages that are illustrated in FIG. 3. Each additional stage may include a row of turbine stator blades 68 followed by a row of turbine rotor blades 66.

In use, the rotation of compressor rotor blades 60 within the axial compressor 52 may compress a flow of air. In the combustor 56, energy may be released when the compressed air is mixed with a fuel and ignited. The resulting flow of hot gases from the combustor 56, which may be referred to as the working fluid, is then directed over the turbine rotor blades 66, the flow of working fluid inducing the rotation of the turbine rotor blades 66 about the shaft. Thereby, the energy of the flow of working fluid is transformed into the mechanical energy of the rotating blades and, because of the connection between the rotor blades and the shaft, the rotating shaft. The mechanical energy of the shaft may then be used to drive the rotation of the compressor rotor blades 60, such that the necessary supply of compressed air is produced, and also, for example, a generator to produce electricity.

It will be appreciated that to communicate clearly the invention of the current application, it may be necessary to select terminology that refers to and describes certain machine components or parts of a turbine engine. Whenever possible, common industry terminology will be used and employed in a manner consistent with its accepted meaning. However, it is meant that any such terminology be given a broad meaning and not narrowly construed such that the meaning intended herein and the scope of the appended claims is unreasonably restricted. Those of ordinary skill in the art will appreciate that often certain components may be referred to with several different names. In addition, what may be described herein as a single part may include and be referenced in another context as consisting of several component parts, or, what may be described herein as including multiple component parts may be fashioned into and, in some cases, referred to as a single part. As such, in understanding the scope of the invention described herein, attention should not only be paid to the terminology and description provided, but also to the structure, configuration, function, and/or usage of the component as described herein.

In addition, several descriptive terms may be used herein. The meaning for these terms shall include the following definitions. The term "rotor blade", without further specificity, is a reference to the rotating blades of either the compressor 52 or the turbine 54, which include both compressor rotor blades 60 and turbine rotor blades 66. The term "stator blade", without further specificity, is a reference the stationary blades of either the compressor 52 or the turbine 54, which include both compressor stator blades 62 and turbine stator blades 68. The term "blades" will be used herein to refer to either type of blade. Thus, without further specificity, the term "blades" is inclusive to all type of turbine engine blades, including compressor rotor blades 60, compressor stator blades 62, turbine rotor blades 66, and turbine stator blades 68. Further, as used herein, "downstream" and "upstream" are terms that indicate a direction relative to the flow of working fluid through the turbine. As such, the term "downstream" means the direction of the flow, and the term "upstream" means in the opposite direction of the flow through the turbine. Related to these terms, the terms "aft" and/or "trailing edge" refer to the downstream direction, the downstream end and/or in the direction of the downstream end of the component being described. And, the terms "forward" and/or "leading edge" refer to the upstream direction, the upstream end and/or in the direction of the upstream end of the component being described. The term "radial" refers to movement or position perpendicular to an axis. It is often required to described parts that are at differing radial positions with regard to an axis. In this case, if a first component resides closer to the axis than a second component, it may be stated herein that the first component is "inboard" or "radially inward" of the second component. If, on the other hand, the first component resides further from the axis than the second component, it may be stated herein that the first component is "outboard" or "radially outward" of the second component. The term "axial" refers to movement or position parallel to an axis. And, the term "circumferential" refers to movement or position around an axis.

Referring again to the figures, FIG. 4 illustrates a sectional view of a configuration of the last stage of a compressor and the compressor diffuser according to conventional design. As shown, the last stage of a compressor is shown, which includes a row of compressor rotor blades 60 (disposed on a rotor disk 82) and, downstream of the compressor rotor blades 60, a row of compressor stator blades 62. Downstream of the stator blades 62 is the diffuser 83, which, in general, comprises a smooth outward flaring of the flowpath from an inlet area 84 to an exit area 85. An outer wall 88 forms the outer flowpath boundary in the last stage and the diffuser 86, while an inner wall 90 forms the inner flowpath boundary downstream of the last row of compressor rotor blades 60. As shown, the stator blade 62 is attached at one end to the outer wall 88 and at the other by the inner wall 90. This type of construction is typical and desired as it solidly anchors both ends of the stator blade 62.

Figure 5:
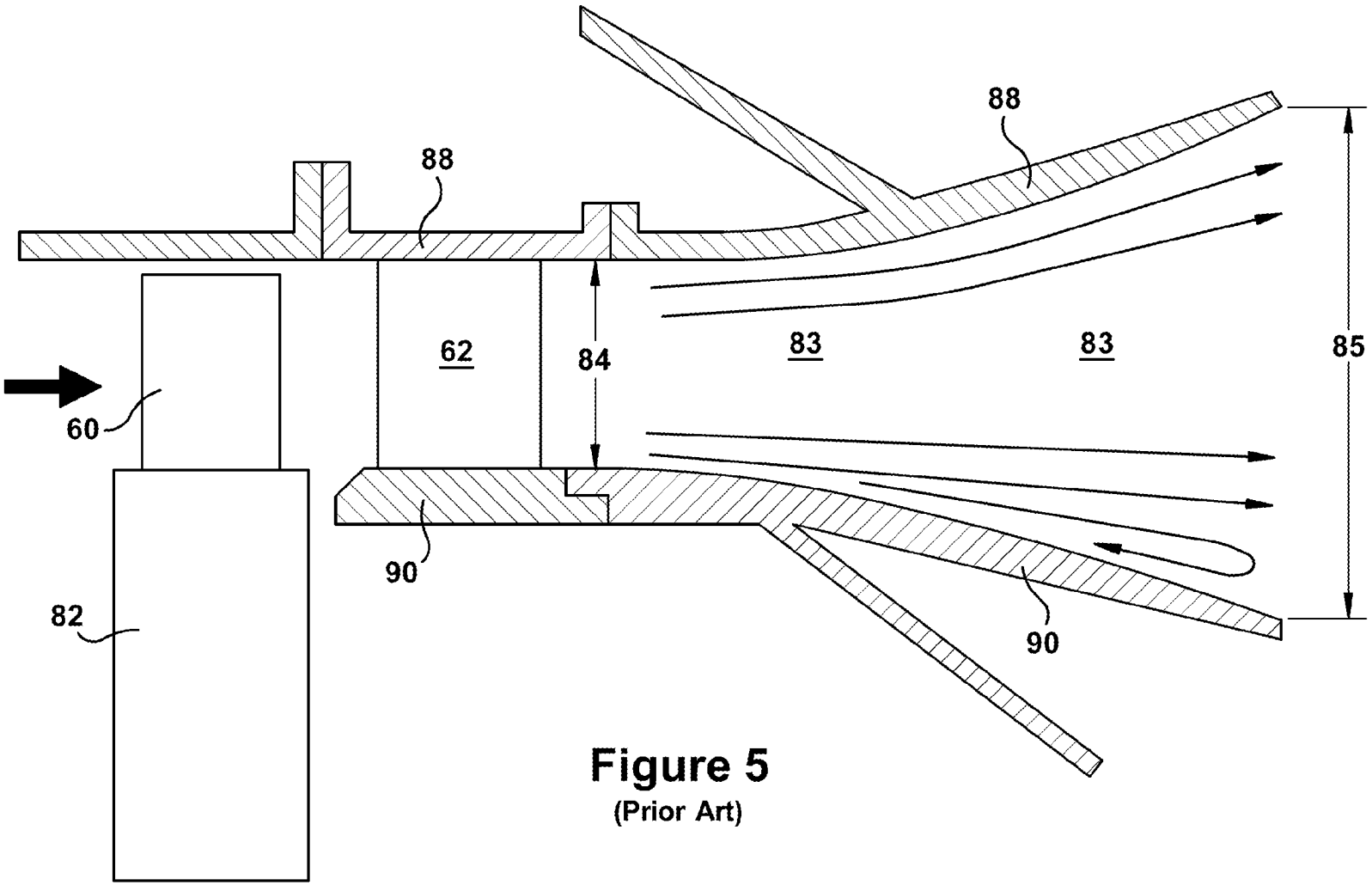
Figure 5 (Prior Art)
FIG. 5 is another sectional view of a configuration of the last stage of a compressor and the compressor diffuser according to conventional design.

As shown in FIG. 4, in conventional configurations, the ratio of exit area 85 to inlet area 84 is limited. That is, if the diffuser 83 flares outwardly too quickly (i.e., increasing the exit area of the diffuser significantly over a relatively small axial length), the risk of incurring significant losses due to boundary layer flow reversal increases. FIG. 5 illustrates a diffuser 83 in which the exit area 85 increases at a higher rate over the same axial distance as the diffuser 83 shown in FIG. 4. In this case, as the flow pattern indicates, boundary layer flow reversal forms. As one of ordinary skill in the art will appreciate, this generally results in significant aerodynamic losses.

Figure 6:
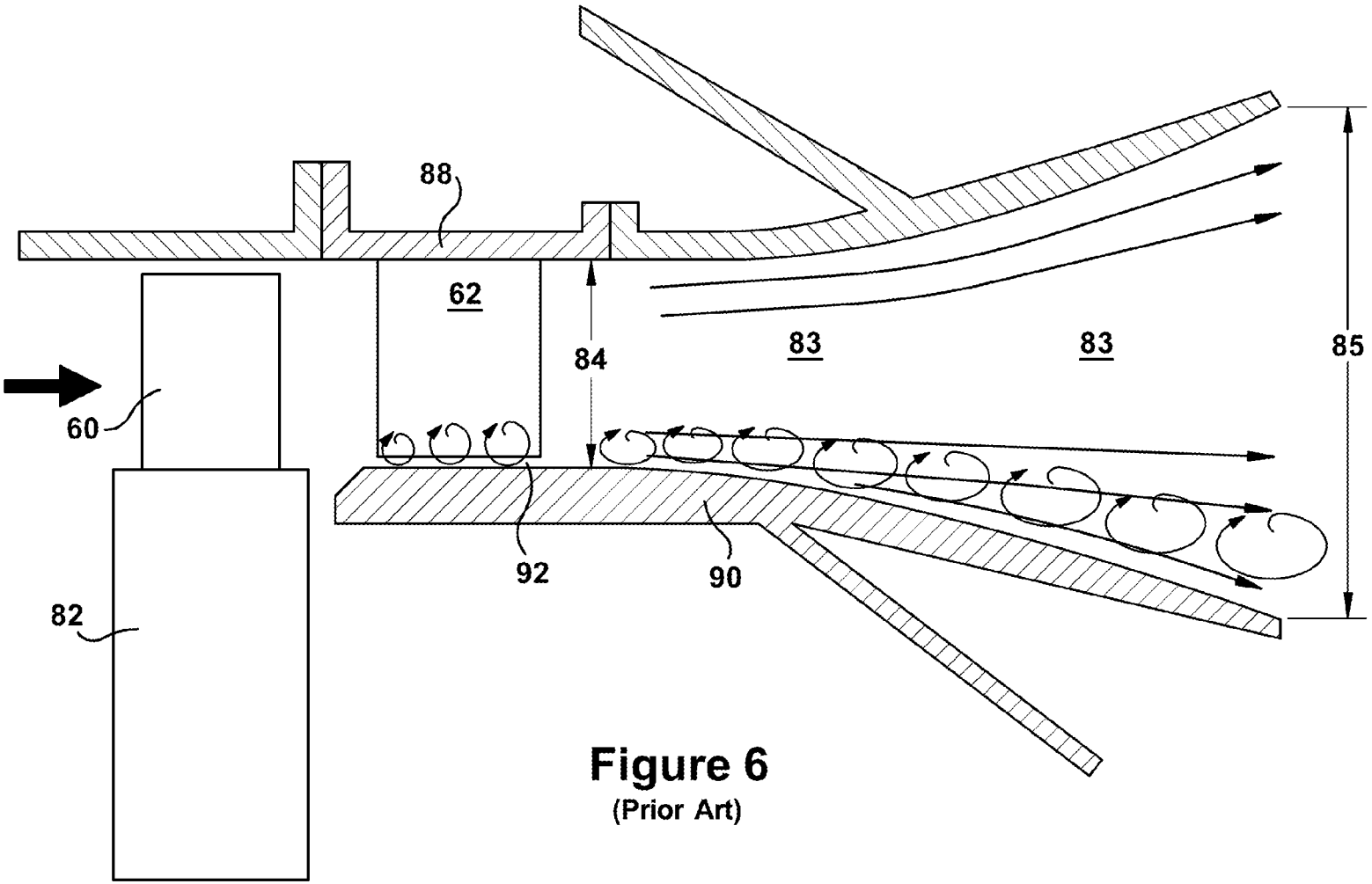
Figure 6 (Prior Art)
FIG. 6 is another sectional view of a configuration of the last stage of a compressor and the compressor diffuser according to conventional design.

FIG. 6 illustrates a diffuser 83 that is similar to the one depicted in FIG. 5. In this case, however, the stator blade 62 has been modified so that a gap 92 remains between the stator blade 62 and the inner wall 90 along the entire length of the stator blade 62. That is, extending from the outer wall 88, the stator blade 62 terminates before reaching the inner wall 90, leaving a narrow gap 92. With this configuration, vortices form along the inner end wall 90, and these vortices are carried along the inner wall 90 through the diffuser. As discussed further detail below, the vortices form because of the differences between the flow that is redirected or "turned" by the stator blade 62 and the flow that travels through the gap 92. That is, the flow through the stator blades 62 is directed or turned pursuant to the curvature of the stator blades, whereas the flow that flows through the gap 92 does not turn and continues in a substantially straight path. As one of ordinary skill in the art will appreciate, vortices form because of these different flow characteristics. Once formed, these vortices mix low momentum boundary layer flow with high momentum free stream flow. This mixing energizes the boundary layer along the inner wall 90. The energized boundary layer reduces aerodynamic losses through the diffuser 83 and, particularly, the energized inner wall boundary layer downstream improves resistance to flow reversal during diffusion. This allows more aggressive diffuser design, i.e., diffusers with increase exit to inlet area ratios.

However, terminating the stator blade 62 before it makes a connection with the inner wall 90 presents other issues. First, this is an atypical method of construction, which generally increases manufacturing and construction costs. Second, it places greater strain on the connection the stator blade 62 makes with the outer wall 88, which complicates the anchoring means, requires different materials, and/or increases construction costs. Third, with the stator blade 62 only being anchored at one end, the stator blade 62 may vibrate during certain operational conditions to the extent that losses are incurred and part-life negatively affected.

Figure 7:
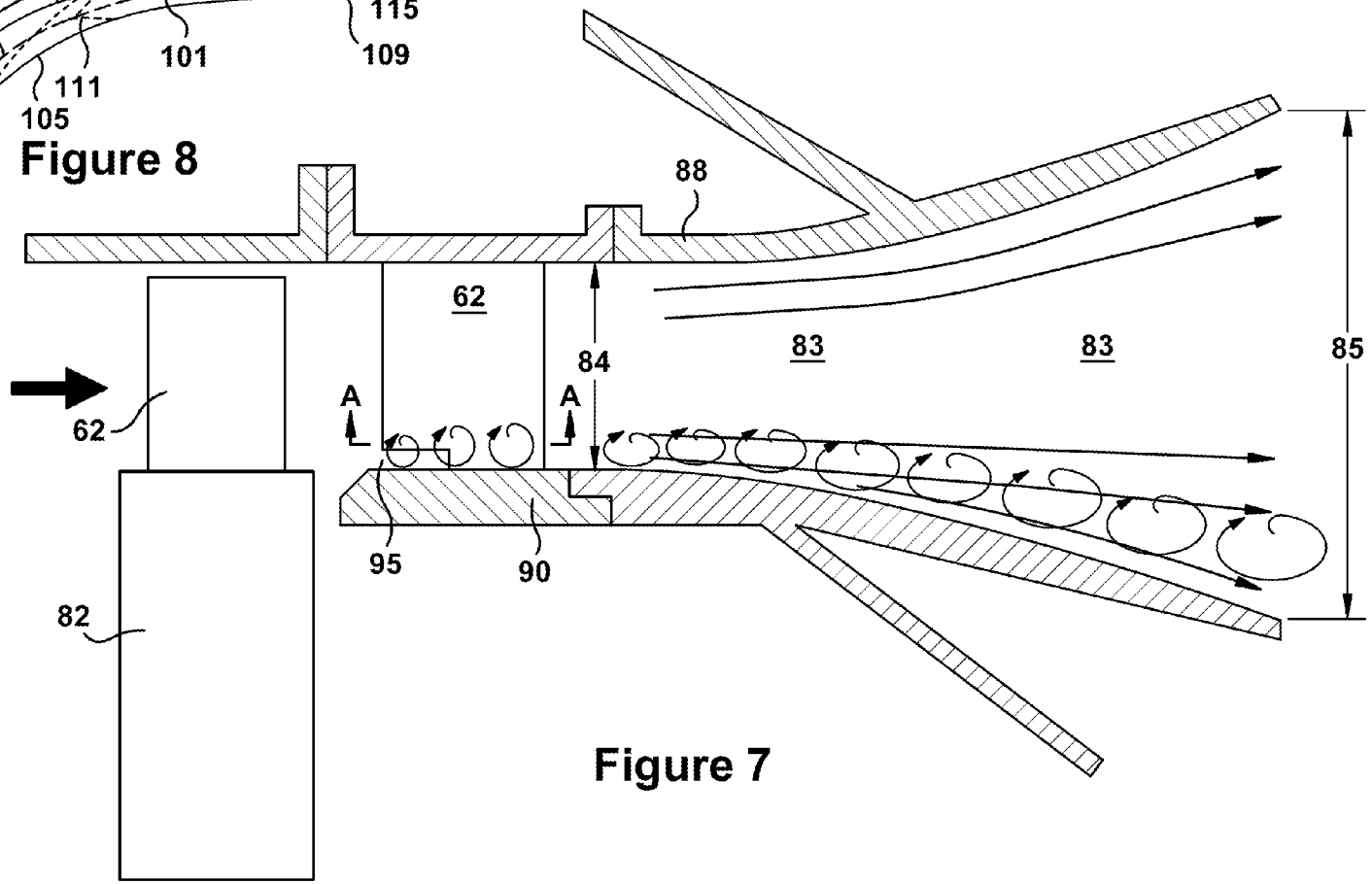
FIG. 7 is a sectional view of a configuration of the last stage of a compressor and the compressor diffuser according to an embodiment of the present application.

Referring now to FIG. 7, a sectional view of a configuration of the last stage of a compressor and the compressor diffuser according to an embodiment of the present application is provided. As shown, in accordance with the present application, a forward notch 95 is formed along the inboard side of the stator blade 62, which, as such, may be referred to as an inboard forward notch 95. As used herein, a forward notch 95 comprises a cut-out section in the forward section of the stator blade 62 along either the inner wall 90 or, as discussed more below, the outer wall 88. As shown, the forward notch 95 may have a radial height (which is specifically identified in FIG. 10). It will be appreciated that the radial height of the forward notch 95 defines the height of the gap that is created between the stator blade 62 and the inner wall 92. In preferred embodiments, the radial height may be substantially constant over the length of the forward notch 95, which means that the radially aligned surfaces that define the forward notch 95 (i.e., the inner wall 90 and the inboard surface of the stator blade 62 that opposes the inner-wall 90) are substantially parallel.

Further, as depicted in the embodiment provided in FIG. 7, the inboard forward notch 95 may have an axial length that is less than the axial length of the stator blade 62. That is, the inboard forward notch 95 extends only partially down the length of the stator blade 62. Unlike the stator blade 62 shown in FIG. 6, the inboard forward notch 95 of the present application allows the stator blade 62 to still be anchored at both of its ends, i.e., along the inner wall 88 and the outer wall 90. Being able to connect the stator blade 62 at both ends to the structure that defines the flow path is desirable, as already stated, because, among other reasons, it is consistent with many conventional construction methods and blade anchoring methods. As a result, stator blades 62 that are formed pursuant to the present application generally may be integrated/retrofitted into turbine engines having conventional design. Further, the dual-connection allows for simpler design, the use of more cost-effective materials, more cost-effective assembly, and/or provides a more securely anchored stator blade 62 that is more durable and vibrates less during operation.

Figure 8:
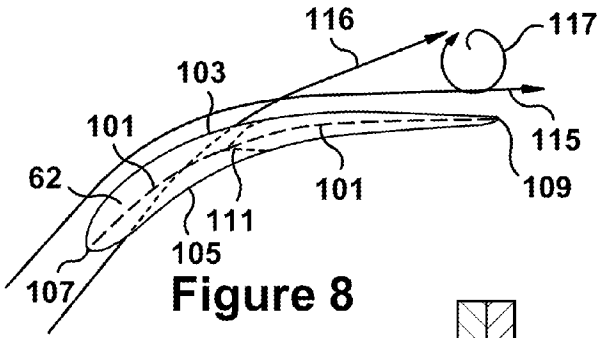
FIG. 8 is a top view of a stator blade according to an embodiment of the present application.

The length of the inboard forward notch 95 (i.e., how far the cut-out area extends from the leading edge of the stator blade 62 toward its trailing edge) may be better appreciated by referring to FIG. 8. FIG. 8 provides a top view of a stator blade 62 according to an embodiment of the present application. A midpoint reference line 101 is provided that connects the midpoints between the suction side 103 and the pressure side 105 of the stator blade 62. The midpoint reference line 101 runs the length of the stator blade 62, connecting a leading edge 107 and a trailing edge 109 of the blade 62. A notch leading edge 111 also is shown. The notch leading edge 111 represents the leading edge of the stator blade 62 within the inboard forward notch 95. It will be appreciated that the notch leading edge 111 is the termination point of the inboard forward notch 95. As shown, in preferred embodiments, the notch leading edge 111 may include a smooth, rounded airfoil shape that is similar to the leading edge 107. In generally, the length of the inboard forward notch 95 may vary depending on the shape of the airfoil of the stator blade 62. In some embodiments, the length of the inboard forward notch 95 is such that a significant portion of the curvature of the airfoil of the stator blade 62 is bypassed by the flow through the forward notch 95 (so that the desired vortices form), while not being so long that an adequately sturdy connection cannot be made between the inner wall 90 and the intact remainder.

In some cases, the length of the inboard forward notch 95 in accordance with embodiments of the present invention may be more particularly expressed by comparing the distance from the leading edge 107 to the trailing edge 109 along the midpoint reference line 101 to the distance from the leading edge 107 to the notch leading edge 111 along the midpoint reference line. It will be appreciated by one of ordinary skill in the art that, in general, compressor stator blades 62 are designed such that the majority of the flow-directing curvature occurs along the leading or forward half of the blade (as shown in FIG. 8). As a result, the design of the present application (which proposes removing only a section from the more curved upstream portion of the stator blade 62) provides substantially the same level of beneficial boundary layer energizing as the design shown in FIG. 6, while still allowing the stator blade 62 to be securely anchored along both the outer wall 88 and the inner wall 90.

The several arrows of FIG. 8 depict the resulting flow around the stator blade 62 having an inboard forward notch 95 according to the present application. A first portion of the flow (as depicted by arrow 115) is "turned" by the curvature of the stator blade 62. However, a second portion of the flow (as depicted by arrow 116) travels through the forward notch 95 and, thereby, bypasses the most curved section of the stator blade 62. As such, from the stator blade 62, the second portion of the flow 116 proceeds in a different direction than the first portion of flow 115. As one of ordinary skill in the art will appreciate, the flow differences between the first portion of flow 115 and the second portion of flow 116 create vortices 117. As stated, these vortices 117 mix low momentum boundary layer flow with high momentum free stream flow, thereby energizing the boundary layer along the inner wall. The boundary layer, thus energized, generally reduces losses through the diffuser 83 and, particularly, improves resistance to flow reversal during diffusion, which allows for diffusers 83 with higher exit area to inlet area ratios.

As stated above, the length of the forward notch 95 according to aspects of the present invention may be expressed by comparing it to the size or length of the stator blade 62. Particularly, the distance from the leading edge 107 to the trailing edge 109 along the midpoint reference line 101 (i.e., the total length or "TL") may be compared to the distance from the leading edge 107 to the notch leading edge 111 along the midpoint reference line (i.e., the notch length or "NL"). In certain embodiments of the present application, the stator blade 62/forward notch 95 is configured such that ratio of "NL/TL" comprises a range of between approximately 0.05 and 0.50. At this ratio, it has been discovered that the flow through the forward notch bypasses at least an appreciable amount of the curvature of the stator blade 62 that occurs along the forward areas of the blade 62, which results in the formation of desired vortices, while also leaving an adequate section of the stator blade 62 intact so that a solid connection may be made between the stator blade 62 and the inner wall 90. In more preferred embodiments, the stator blade 62/forward notch 95 is configured such that ratio of NL/TL comprises a range of between approximately 0.10 and 0.35. At this narrower ratio, it has been discovered that the flow through the forward notch 95 bypasses at least a significant amount of the curvature of the stator blade 62 that occurs along the forward areas of the stator blade 62 so that stronger vortices form, while also leaving a significant section of the stator blade 62 in tact so that a solid connection may be made between the stator blade 62 and the inner wall 90. Ideally, the stator blade 62/forward notch 95 is configured such that ratio of NL/TL comprises a range of between approximately 0.15 and 0.25. At this even narrower ratio, it has been discovered that the flow through the forward notch bypasses at least an optimum amount of the curvature of the stator blade 62 that occurs along the forward areas of the stator blade 62 so that strong vortices form, while also leaving a substantial section of the stator blade 62 intact so that a solid connection may be made between the stator blade 62 and the inner wall 90.

Figure 9:
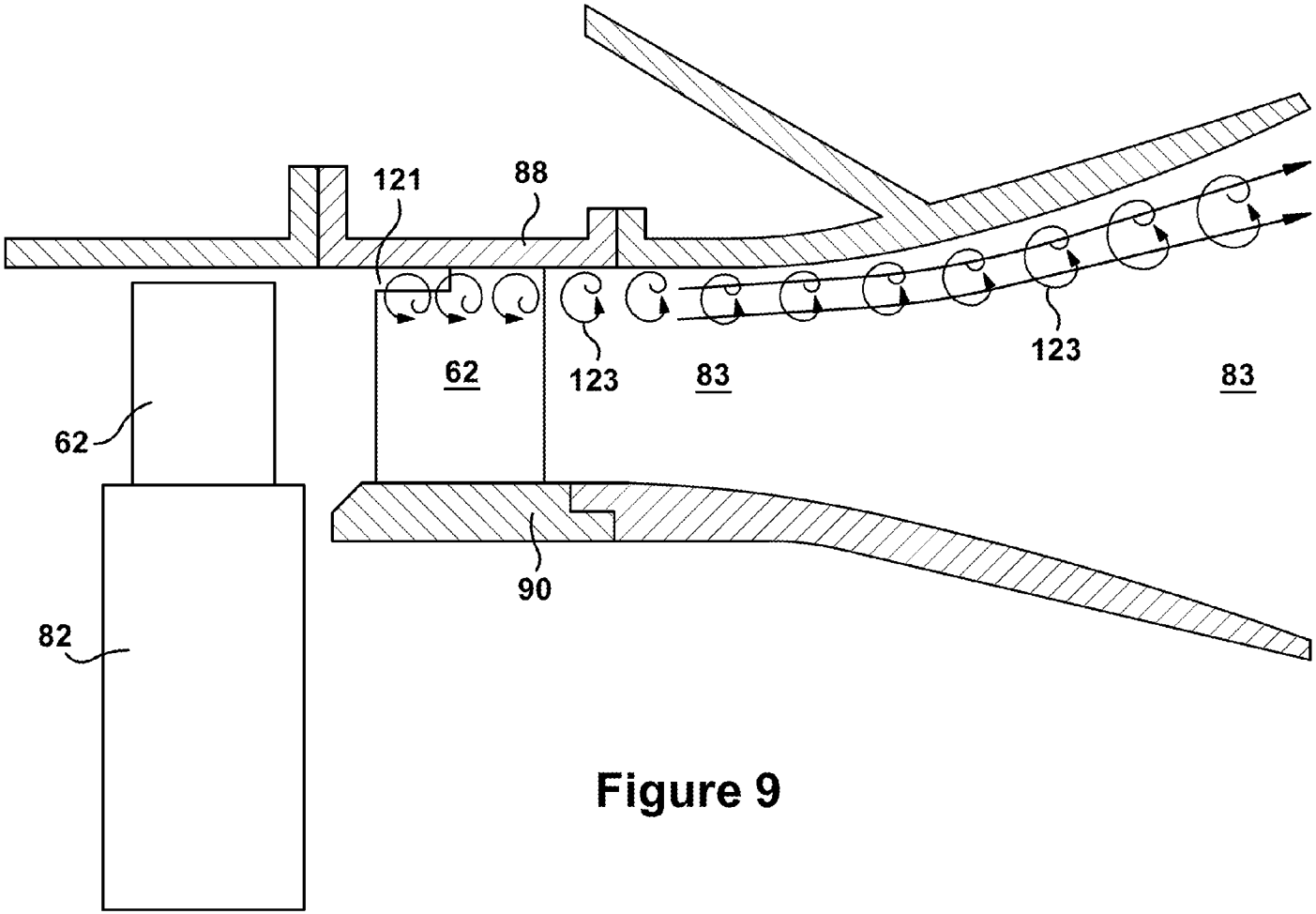
FIG. 9 is a sectional view of a configuration of the last stage of a compressor and the compressor diffuser according to an embodiment of the present application.

FIG. 9 is a sectional view of a configuration of the last stage of a compressor and the compressor diffuser according to an alternative embodiment of the present application. As shown in FIG. 9, a forward notch 121 may be formed at the outboard edge of the stator blade 62, i.e., at the location where the outboard edge of the stator blade 62 connects to the outer wall 88. Thus, given the location, the forward notch 121 of FIG. 9 also may be referred to as an "outboard forward notch 121". The outboard forward notch 121 may function the same as that described in relation to the inboard forward notch 95, except, of course, the outboard forward notch 121 produces vortices 123 that hug the outer wall 88 and, thereby, prevent losses along the outer wall 88. In substantially all of the ways, the outboard forward notch may be implement in the ways (i.e., sizing, dimensions, orientation, axial location, etc.) described above in relation to the inboard forward notch 95. For the sake of brevity, these different alternatives will not be provided again.

Figure 10:
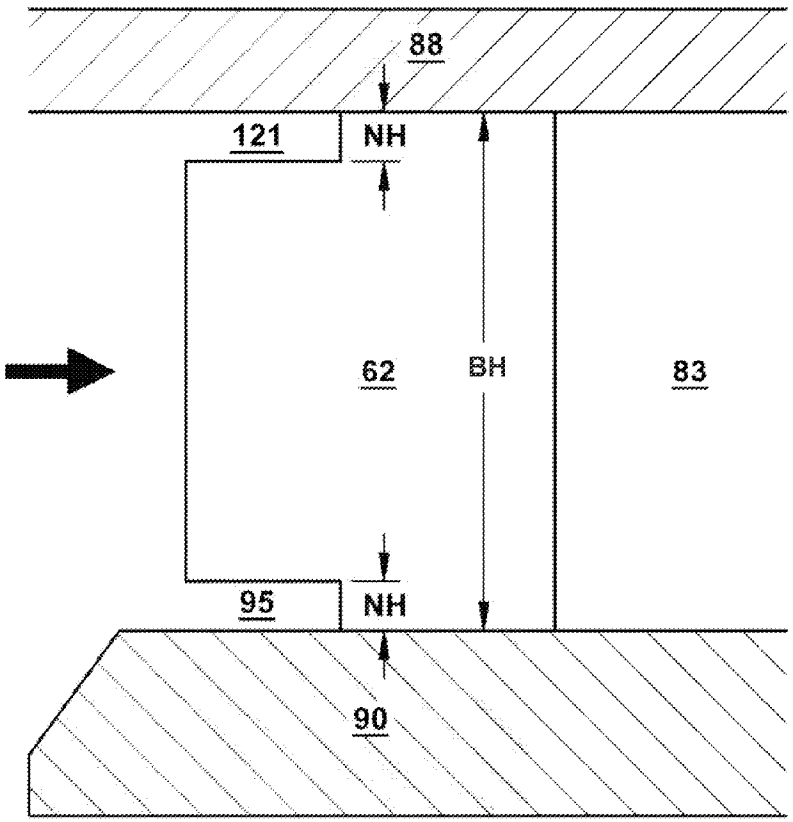
FIG. 10 is a side view of a stator blade according to an exemplary embodiment of the present application.

FIG. 10 is a side view of a stator blade according to another embodiment of the present application. As shown in FIG. 10, in accordance with exemplary embodiments, stator blades 62 may be formed to include both an outboard forward notch 121 and an inboard forward notch 95. In this manner, the desired vortices and energized boundary layers may be formed along both the inner wall 90 and the outer wall 88 of the diffuser 83.

FIG. 10 further illustrates another dimensional component that may affect the operation of the forward notch 95, 121 (whether the forward notch 95, 121 is located on the outer wall 88, the inner wall 90, or both the outer wall 88 and the inner wall 90). As shown, a distance indicating the height of the forward notch 95, 121 (i.e., the notch height or "NH") is indicated on both the inboard forward notch 95 and the outboard forward notch 121. Also, a distance indicating the radial height of the stator blade 62 (i.e., a blade height or "BH") is indicated. This distance also generally coincides with the distance between the outer wall 90 and the inner wall 88. In certain preferred embodiments of the present application, the stator blade 62, the inboard forward notch 95, and the outboard forward notch 121 may be configured such that ratio of "NH/BH" comprises a range of between approximately 0.005 and 0.05. At this ratio, it has been discovered that the flow through the forward notch 95, 121 is generally sufficient so that desired vortices form. In more preferred embodiments, the stator blade 62, the inboard forward notch 95, and the outboard forward notch 121 may be configured such that ratio of "NH/BH" comprises a range of between approximately 0.01 and 0.03.

In addition, the height of the forward notch 95, 121 may be specified within certain non-relative distance ranges that generally prove effective over a broad range of stator blade 62 heights. Accordingly, in some preferred embodiments of the present application, the radial height of the forward notch 95, 121 comprises a range of between approximately 0.5 to 5 mm.

More preferably, the height of the forward notch 95, 121 comprises a range of between approximately 1 to 3 mm.

In operation, embodiments of the present application enable more aggressive, higher exit to inlet area ratio diffusers by employing a forward notch 95, 121 that causes the formation of vortices that energize the boundary layer. As described, the aerodynamic interaction of the flow through the stator blade 62 and the flow that flows through the forward notch 95, 121 produces a vortex that energizes the inner wall 90 boundary layer or the outer wall 88 boundary layer downstream of the stator blade 62 for improved resistance to flow reversal, which may cause significant losses. In addition, these advantages are achieved while also maintaining substantially standard stator blade construction and attachment techniques.

As one of ordinary skill in the art will appreciate, the many varying features and configurations described above in relation to the several exemplary embodiments may be further selectively applied to form the other possible embodiments of the present invention. For the sake of brevity and taking into account the abilities of one of ordinary skill in the art, each possible iteration is not herein discussed in detail, though all combinations and possible embodiments embraced by the several claims below are intended to be part of the instant application. In addition, from the above description of several exemplary embodiments of the invention, those skilled in the art will perceive improvements, changes and modifications. Such improvements, changes and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

I claim:

1. A row of stator blades in an axial compressor of a combustion turbine engine, the combustion turbine engine including a diffuser located axially downstream of the compressor, and the row of stator blades disposed in close proximity to the diffuser; the row of stator blades comprising:

a plurality of stator blades that include at least one of an inboard forward notch and an outboard forward notch;

wherein:

each stator blade within the row of stator blades connects, at an outer radial edge, to an outer wall and, at an inner radial edge, to an inner wall;

the outer wall defining an outer flowpath boundary of a main flowpath of the compressor and the inner wall defining an inner flowpath boundary of the main flowpath of the compressor;

the inboard forward notch comprises a cut-out section that extends rearward a first predetermined distance from a leading edge of the stator blade along the inner wall, the first predetermined distance comprising a distance less than a length of the stator blade; and the outboard forward notch comprises a cut-out section that extends rearward a second predetermined distance from a leading edge of the stator blade along the outer wall, the second predetermined distance comprising a distance less than the length of the stator blade.

2. The row of stator blades according to claim 1, wherein a majority of the stator blades comprise at least one of the inboard forward notch and the outboard forward notch.

3. The row of stator blades according to claim 1, wherein all of the stator blades comprise at least one of the inboard forward notch and the outboard forward notch.

4. The row of stator blades according to claim 1, wherein all of the stator blades comprise the inboard forward notch.

5. The row of stator blades according to claim 1, wherein all of the stator blades comprise the outboard forward notch.

6. The row of stator blades according to claim 1, wherein all of the stator blades comprise the inboard forward notch and the outboard forward notch.

7. The row of stator blades according to claim 1, wherein the row of stator blades comprises a first row of stator blades disposed in the upstream direction from the diffuser.

8. The row of stator blades according to claim 1, wherein:

the inboard forward notch comprises a notch height that defines a radial height of the inboard forward notch and the notch height is substantially constant over a length of the inboard forward notch; and the outboard forward notch comprises a notch height that defines a radial height of the outboard forward notch and the notch height is substantially constant over a length of the outboard forward notch.

9. The row of stator blades according to claim 8, wherein, in a ratio of NH/BH:

"NH" comprises the notch height of the inboard forward notch and/or the notch height of the outboard forward notch; and "BH" comprises the radial height of the stator blade;

wherein the stator blade and the inboard forward notch and/or the outboard forward notch are configured such that the ratio of "NH/BH" comprises a range of between approximately 0.005 and 0.05.

10. The row of stator blades according to claim 8, wherein, in a ratio of NH/BH:

"NH" comprises the notch height of the inboard forward notch and/or the notch height of the outboard forward notch; and "BH" comprises a radial height of the stator blade;

wherein the stator blade and the inboard forward notch and/or the outboard forward notch are configured such that the ratio of "NH/BH" comprises a range of between approximately 0.01 and 0.03.

11. The row of stator blades according to claim 8, wherein, the notch height of the inboard forward notch and/or the notch height of the outboard forward notch comprises a range of between approximately 0.5 and 5 mm.

12. The row of stator blades according to claim 8, wherein, the notch height of the inboard forward notch and/or the notch height of the outboard forward notch comprises a range of between approximately 1 and 3 mm.

13. The row of stator blades according to claim 1, wherein:

a midpoint reference line comprises a reference line that connects midpoints between a suction side and a pressure side of the stator blades within the row of stator blades, the midpoint reference line extending between the leading edge and the trailing edge of the stator blades;

a notch leading edge comprises the leading edge of the stator blade within the inboard forward notch and/or the outboard forward notch;

a length of the inboard forward notch comprises a distance from the leading edge that the inboard forward notch extends rearwardly down the midpoint reference line; and a length of the outboard forward notch comprises a distance from the leading edge that the outboard forward notch extends rearwardly down the midpoint reference line.

14. The row of stator blades according to claim 13, wherein the length of the inboard forward notch and/or the outboard forward notch comprises a length that allows a significant portion of the forward curvature of an airfoil of the stator blade to be bypassed by a flow through the inboard forward notch and/or the outboard forward notch, while also allowing the stator blade to be sturdily connected to both the inner wall and the outer wall.

15. The row of stator blades according to claim 13, wherein the notch leading edge comprises a smooth, rounded airfoil shape.

16. The row of stator blades according to claim 13, wherein, in a ratio of NL/TL:

"TL" comprises the distance along the midpoint reference line from the leading edge to the trailing edge of the stator blades in the row of stator blades;

"NL" comprises the distance along the midpoint reference line from the leading edge to the notch leading edge of the stator blades in the row of stator blades;

wherein the stator blades and the inboard forward notch and/or the outboard forward notch are configured such that the ratio of "NL/TL" comprises a range of between approximately 0.05 and 0.5.

17. The row of stator blades according to claim 13, wherein, in a ratio of NL/TL:

"TL" comprises the distance along the midpoint reference line from the leading edge to the trailing edge of the stator blades in the row of stator blades;

"NL" comprises the distance along the midpoint reference line from the leading edge to the notch leading edge of the stator blades in the row of stator blades;

wherein the stator blades and the inboard forward notch and/or the outboard forward notch are configured such that the ratio of "NL/TL" comprises a range of between approximately 0.10 and 0.35.

18. The row of stator blades according to claim 13, wherein, in a ratio of NL/TL:

"TL" comprises the distance along the midpoint reference line from the leading edge to the trailing edge of the stator blades in the row of stator blades;

"NL" comprises the distance along the midpoint reference line from the leading edge to the notch leading edge of the stator blades in the row of stator blades;

wherein the stator blades and the inboard forward notch and/or the outboard forward notch are configured such that the ratio of "NL/TL" comprises a range of between approximately 0.15 and 0.25.

19. A row of stator blades in an axial compressor of a combustion turbine engine, the combustion turbine engine including a diffuser located axially downstream of the compressor, and the row of stator blades disposed in close proximity to the diffuser; wherein:

each of the stator blades within the row comprises an inboard forward notch and an outboard forward notch;

the row of stator blades comprises a first row of stator blades disposed in the upstream direction from the diffuser;

each stator blade within the row of stator blades connects, at an outer radial edge, to an outer wall and, at an inner radial edge, to an inner wall;

the outer wall defining an outer flowpath boundary of a main flowpath of the compressor and the inner wall defining an inner flowpath boundary of the main flowpath of the compressor;

the inboard forward notch comprises a cut-out section that extends rearward a first predetermined distance from a leading edge of the stator blade along the inner wall, the first predetermined distance comprising a distance less than a length of the stator blade; and the outboard forward notch comprises a cut-out section that extends rearward a second predetermined distance from a leading edge of the stator blade along the outer wall, the second predetermined distance comprising a distance less than the length of the stator blade;

the first predetermined distance of the inboard forward notch comprises a distance that allows a significant portion of a forward curvature of an airfoil of the stator blade to be bypassed by a flow through the inboard forward notch; and the second predetermined distance of the outboard forward notch comprises a distance that allows a significant portion of the forward curvature of the airfoil of the stator blade to be bypassed by a flow through the outboard forward notch.

* * * * *